US007547835B1

(12) United States Patent
Mayor

(10) Patent No.: US 7,547,835 B1
(45) Date of Patent: Jun. 16, 2009

(54) INSTRUMENT SECURING DEVICE

(76) Inventor: Christopher Mayor, 4099 LaPlaya Blvd., Miami, FL (US) 33133

( * ) Notice: Subject to any disclaimer, the term of this patent is extended or adjusted under 35 U.S.C. 154(b) by 0 days.

(21) Appl. No.: 12/147,938

(22) Filed: Jun. 27, 2008

(51) Int. Cl.
*G10D 3/00* (2006.01)

(52) U.S. Cl. ..... 84/327

(58) Field of Classification Search ..... 84/327, 84/329, 421; 248/443; 206/314
See application file for complete search history.

(56) References Cited

U.S. PATENT DOCUMENTS

| | | | | |
|---|---|---|---|---|
| 4,037,815 | A | 7/1977 | DeLano | |
| 4,742,751 | A | 5/1988 | Cherry | |
| 5,301,823 | A | 4/1994 | Kingery | |
| 5,375,497 | A | 12/1994 | Pirchio et al. | |
| 5,454,473 | A | 10/1995 | Hennessey | |
| 6,091,008 | A | 7/2000 | Yu | |
| 6,127,612 | A | 10/2000 | Yu | |
| 6,231,018 | B1 | 5/2001 | Barbieri | |
| 6,439,532 | B1 | 8/2002 | Yu | |
| 6,484,977 | B1 * | 11/2002 | Yu | 248/125.1 |
| 6,513,768 | B1 | 2/2003 | Hsieh | |
| 6,622,981 | B1 | 9/2003 | Hsieh | |
| 6,772,981 | B1 | 8/2004 | Yu | |
| 7,351,896 | B2 | 4/2008 | Clifford | |
| 2002/0070319 | A1 | 6/2002 | Yu | |
| 2002/0124711 | A1 | 9/2002 | Wilfer | |

* cited by examiner

*Primary Examiner*—Kimberly R Lockett
(74) *Attorney, Agent, or Firm*—McHale & Slavin, P.A.

(57) ABSTRACT

The instant invention provides a device for mounting, display, and storage of stringed instruments such as guitars. The device is comprised of a body having a generally U-shaped opening for accepting the neck portion of an instrument. The device provides a secure storage mount for a guitar or other similar instrument whereby the instrument can be secured in the device by merely placing the neck portion of the guitar into the U-shaped opening. The neck of the instrument provides a force that is substantially perpendicular with respect to the instrument neck to cause translation of a slider member. Movement of the slider member provides rotation to a pair of fingers to enclose the neck of the instrument with the U-shaped opening. In a more secure embodiment, an instrument can be locked into place using a locking mechanism that provides selective translation of the slider member. The device provides the capability of being mounted to surfaces as well as new or pre-existing free-standing instrument stands.

13 Claims, 9 Drawing Sheets

INSTRUMENT SECURING DEVICE

FIELD OF INVENTION

The present invention generally relates to devices for holding and/or displaying musical instruments. More particularly it relates to a stand or surface mountable instrument securing device adapted for secure removable storage of at least one musical instrument, specifically but not limited to guitars and other instruments of a similar configuration. The device allows for holding and/or display of an instrument in a vertical or horizontal orientation and features the ability of being able to secure or lock as needed.

BACKGROUND INFORMATION

Musical instruments are particularly sensitive to external mechanical effects. Even a slight contact with the tuning mechanism of a guitar or of a string instrument can adversely affect the tonal qualities of the instrument. Musical instruments must be set aside in such a manner, that their sensitive components are not exposed to contact with the floor, the wall or passers-by.

There are numerous stands available for holding or otherwise accommodating musical instruments having a narrow end and a wide end such as, for example, guitars, bass guitars, and similar string type instruments. With such devices the musical instrument is supported in those areas that are relatively mechanically insensitive. However, they generally do not provide a real means to adequately protect a fragile musical instrument, and fail to provide a means of locking or securing each item individually retained thereupon.

For example, U.S. Pat. No. 5,375,497 discloses a stand for elongate instruments, in particular guitars. The stand comprises a base and a generally vertical main section. The base is provided for set-up of the stand on a generally flat surface. The vertical main section has, in its lower portion, a support assembly for the wider end portion of the musical instrument. At the upper end of the vertical main section, a C or U shaped yoke is provided for the accommodation of the narrower end portion of the musical instrument.

One drawback associated with this type of device relates to its inability to enclose the neck portion of the instrument. For storage, the musical instrument must be placed precisely into the stand by the user. Even minor deviations from the prescribed position can result in instability of the musical instrument. In such a case, even a minor impact could be sufficient to cause the instrument to fall, resulting in detuning or even damage to the musical instrument.

Music stores and private collectors also face the problem of securely holding expensive and fragile instruments to prevent damage while still having them readily available. Additional problems arise when the instruments require being locked in place separately, for individual supervised handling.

In a sales situation, display space is always at a premium, and with valuable and fragile string instruments, it is a common practice to retain these items behind locked, sliding glass doors which limit the display space available. Many times guitars are put on high shelves for display and to keep the patrons from readily handling them without supervision by a store employee. This practice makes it very difficult to get the instrument down for supervised handling. Private collectors on the other hand, do not always desire large display cabinets with sliding glass doors in their homes.

U.S. Pat. No. 5,301,823 discloses a rack for ornamental display of a single instrument. The rack mounts against a vertical wall and is adjustable to accommodate instruments of varying neck widths, head sizes and orientations. While this rack handles a single instrument, it has no locking means to prevent the instrument from becoming dislodged from the rack.

U.S. Pat. No. 4,742,751 discloses an apparatus for holding a guitar in a playing position that connects to the snap fasteners of the guitar body. The apparatus includes a bracket for receiving the strap fasteners and supports the instrument at the strap fasteners. The bracket is supported by a support part such that the instrument is held in a substantially horizontal playing position. This device, however, could not be readily used for storage or sales in that it could easily be knocked over, it requires strap fasteners, and there is no convenient locking means.

U.S. Pat. No. 4,037,815 discloses a musical instrument support for holding an instrument on a wall-mounted bracket in an elevated position above the floor. The instrument support is detachable from the bracket, and is collapsible from a position in which it holds the instrument to a transport or storage position. This device has been designed to support and hold a musical instrument on the wall with its face toward the ceiling where its face cannot be viewed.

U.S. Pat. No. 6,091,008 discloses a guitar hanger that rotates according to a center of gravity of the guitar hung on the hanging device. This device includes a simple U-shape with turned up ends and fails to provide a lock to prevent dislodging of the instrument.

U.S. Pat. No. 6,513,768 discloses a lock for a guitar stand. The device includes a U-shaped opening to accept the neck portion of an instrument. The outwardly extending shafts of the U-shaped opening require a weight to be applied thereto to force the entire locking housing to move in a downward direction with respect to a connecting housing causing the shafts to rotate so that elongated plates rotate to hold the guitar inside the plates. The construction of this device requires the instrument to be hung onto the locking device to provide the weight needed to cause the vertical motion required for rotation of the plates. Hanging instruments may place undue stress on the instrument. Another shortcoming associated with this device relates to its inability to secure the lock in other places along the neck of the instrument. Still yet this device does not allow for supporting the body of the instrument nor does it allow horizontal securing of an instrument.

As such, there is a continuing need for new and improved devices for storage and displaying guitars and similar articles. Such a device should provide secure mounting for at least one instrument while concurrently providing easy removal and replacement of each individual instrument so mounted. Such a device should also provide protection for the delicate exterior of a guitar during removal and mounting. Further, such a device should be designed to provide both a retail sales display mount while concurrently providing private owners and collectors with a device to store and protect their valued possessions in a locked or securely mounted environment.

SUMMARY OF THE INVENTION

In a preferred embodiment, the instant invention provides a secure storage mount for a guitar whereby the guitar can be secured in the device by merely placing the neck of the guitar into the open portion of the body, thereby providing a force that is substantially perpendicular with respect to the neck to cause displacement of a slider and rotation of a pair of fingers to enclose the neck of the instrument. In a most preferred embodiment the weight of the instrument is sufficient to provide the perpendicular force needed to cause translation of the slider member and thus rotation of the fingers. In a more secure embodiment, an instrument can be locked into place using a unique locking mechanism that provides selective translation of the slider member. The device provides the capability of being mounted to surfaces as well as new or pre-existing free-standing instrument stands.

The device is generally comprised of a "Y" shaped body having a generally U-shaped opening for accepting the neck portion of an instrument. The base end which forms the third leg of the Y-shape is generally provided to attach the body to a surface or free-standing instrument stand. A slider member is positioned within the body to partially extend into the U-shaped opening of the body so that placing the neck portion of the instrument within the U-shaped opening causes the slider to translate into the body. A pair of L-shaped fingers are positioned for rotation on each side of the U-shaped opening in response to movement of the slider member for locking the neck portion of an instrument placed therein. The slider member includes a track along which one leg of each finger travels during movement of the slider member causing the fingers to rotate between open and closed positions. A push-button or key-lock assembly may be provided to lock the fingers in the closed position. The fingers may be released by simply moving the neck of the instrument away from the slider member and/or by pushing a button and/or operation of a key lock that allows the slider to translate back into the U-shaped opening.

Accordingly, it is an object of the instant invention to provide an instrument securing device that will securely hold and display at least one instrument.

It is another object of the instant invention to provide an instrument securing device that can be mounted on a surface such as a wall or may also be used in conjunction with a free-standing instrument stand.

Still another object of the instant invention is to provide an instrument securing device that can be mounted to support an instrument in a vertical or horizontal position.

A further object of the instant invention is to supply an instrument securing device that has the ability to lock an individual instrument in a secure manner.

A still further object of the instant invention is to provide an instrument securing device for a guitar like instrument that is securable substantially anywhere along the length of the neck thereof.

Yet a further object of the instant invention is to provide an instrument securing device that provides automatic locking about the neck of an instrument and does not require hanging the instrument by the neck.

Still yet a further object of the instant invention is to provide an instrument securing device that that locks about the neck of the instrument in response to a force that is substantially perpendicular to the neck of the instrument.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENTS

Figure 2:
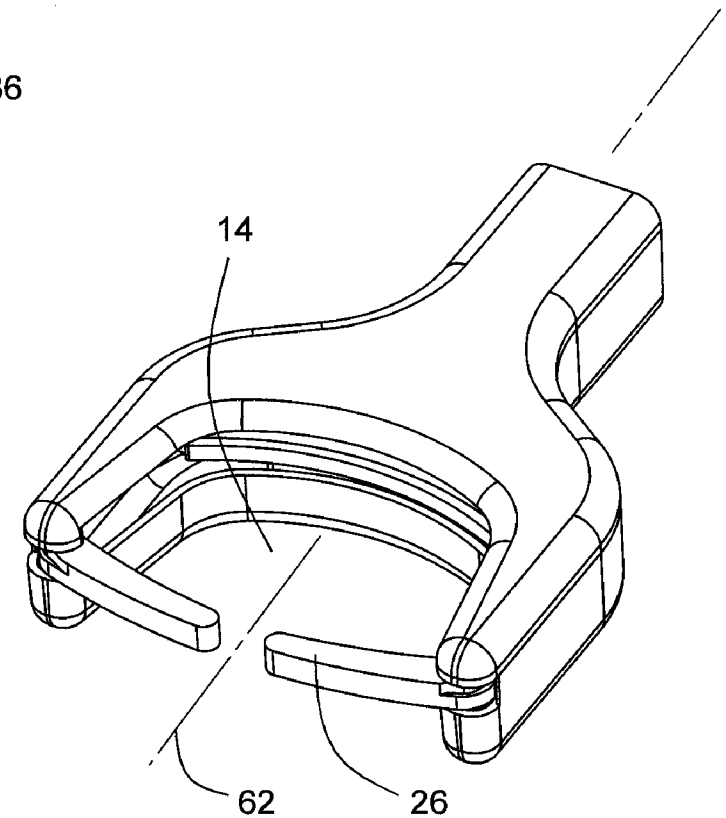
FIG. 2 is a bottom perspective view of one embodiment of the instant invention, illustrating the device in a closed configuration.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Referring generally to FIGS. 1-8, an instrument securing device 10 is illustrated. The instrument securing device generally comprises a body portion 12, a slider member 20, finger member(s) 26, and a locking assembly 40.

Figure 8:
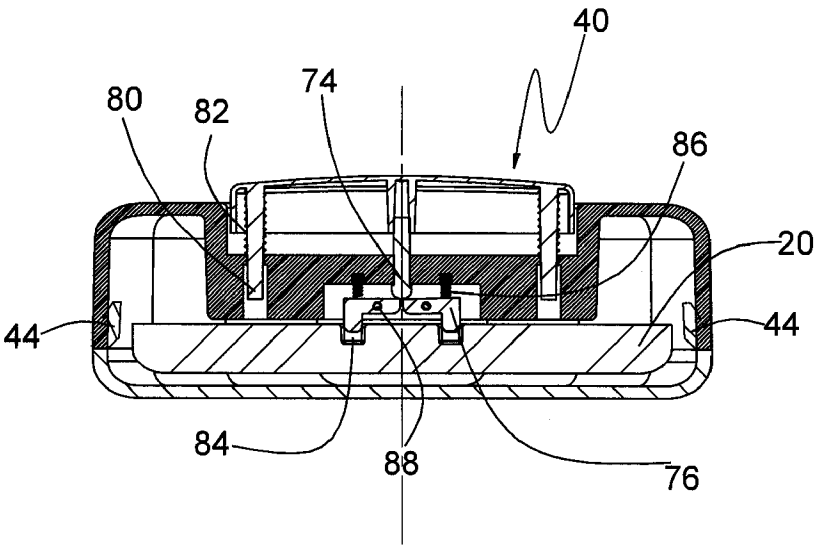
FIG. 8 is a section view taken along lines 8-8 of FIG. 2.
Figure 9:
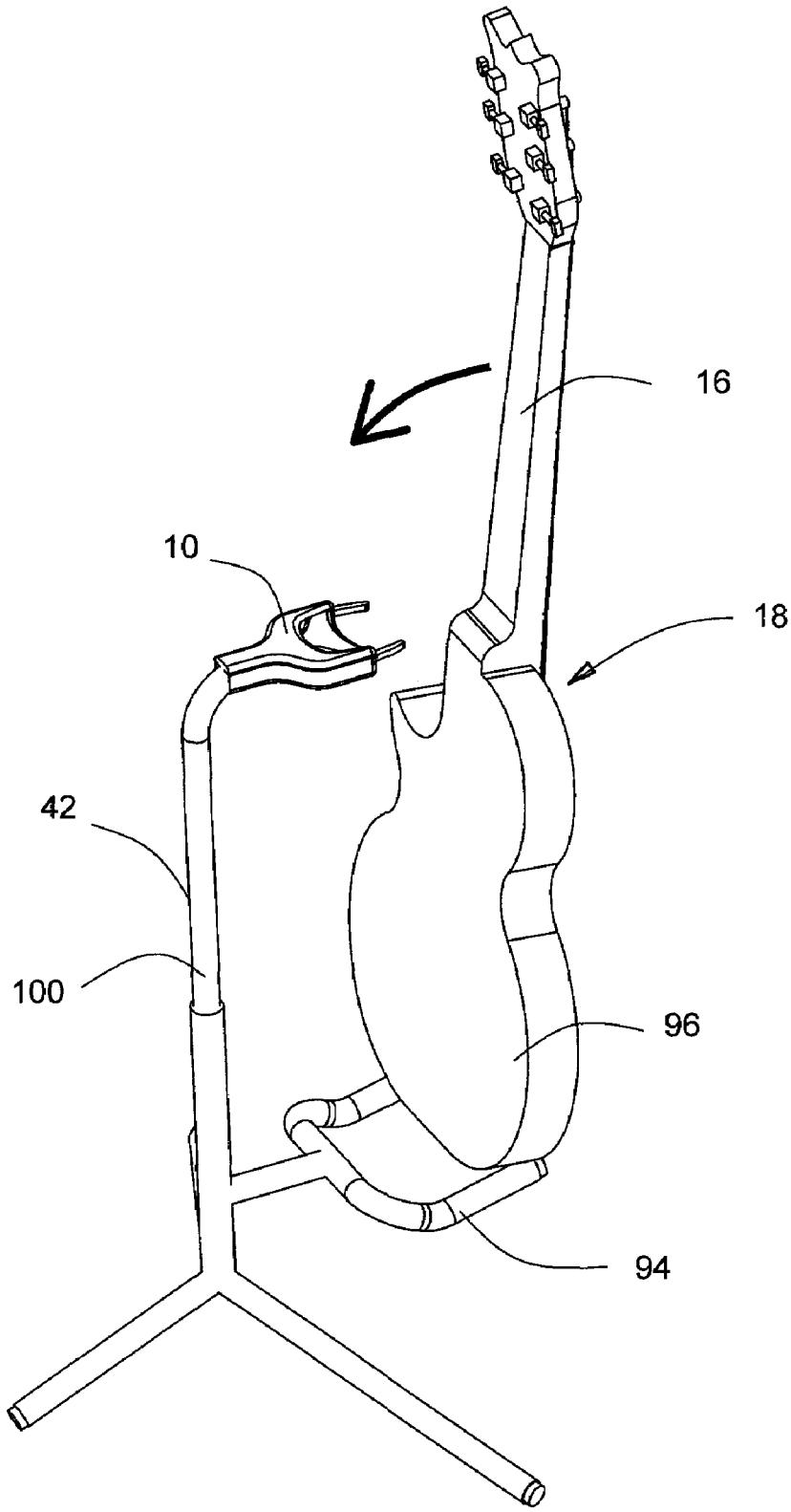
FIG. 9 is a rear perspective view, illustrating engagement of the instant invention to the neck portion of an instrument.

The body portion 12 of the preferred embodiment includes a Y-shape having a substantially U-shaped opening 14 sized to accept a neck portion 16 of an instrument 18 (FIG. 9) while the third leg 36 is constructed and arranged for attachment to a surface 38 (FIG. 11) or free-standing instrument stand 42 (FIG. 9). It should be noted that body portions having shapes other the Y-shape may be utilized without departing from the scope of the invention. The body portion is preferably constructed of an upper portion 12A and a lower portion 12B. The upper and lower portions are preferably constructed of plastic or metal to be generally hollow and are secured together with integrally formed fasteners such as snap-locks 44 (FIG. 8). Other fasteners such as bolts, screws, rivets, adhesives and the like may be utilized without departing from the scope of the invention.

Figure 1:
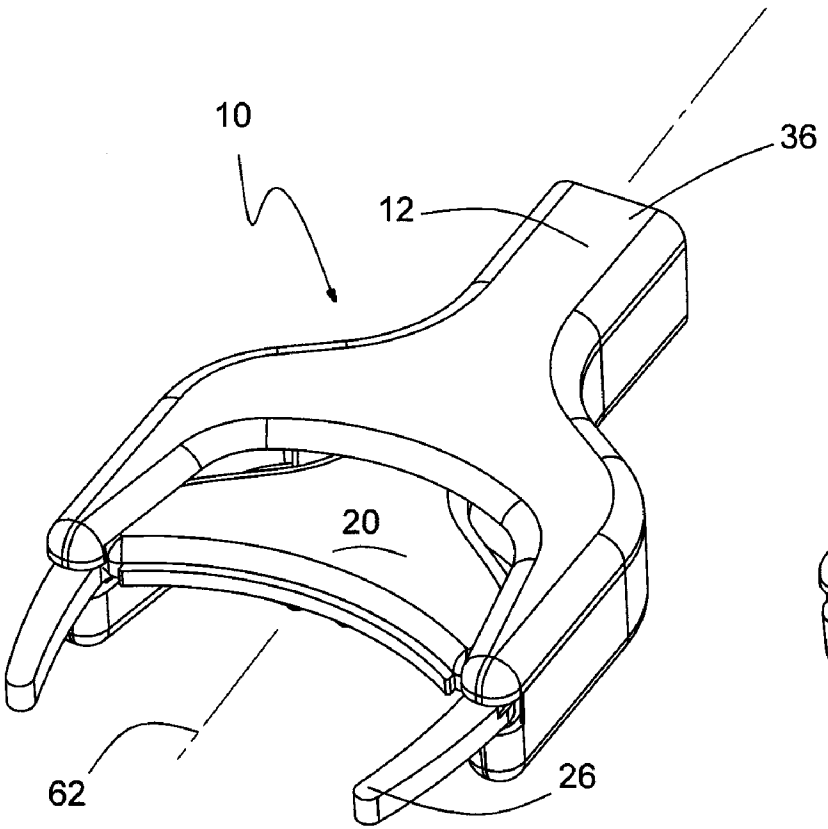
FIG. 1 is a top perspective view of one embodiment of the instant invention, illustrating the device in an open configuration.
Figure 4:
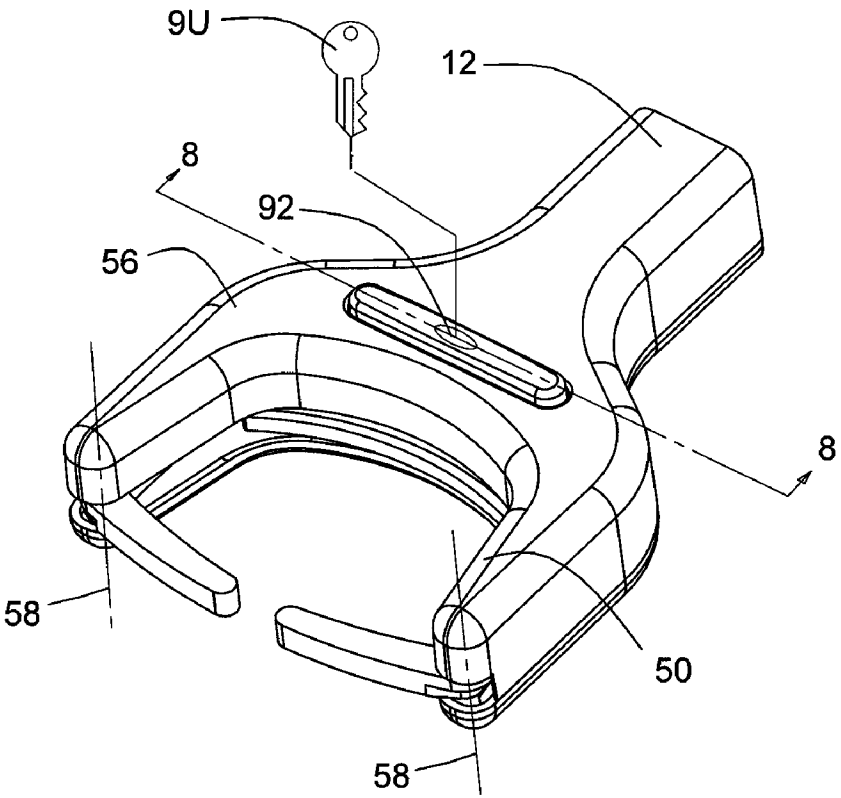
FIG. 4 is a bottom perspective view of one embodiment of the instant invention, illustrating the device in a closed configuration.
Figure 3:
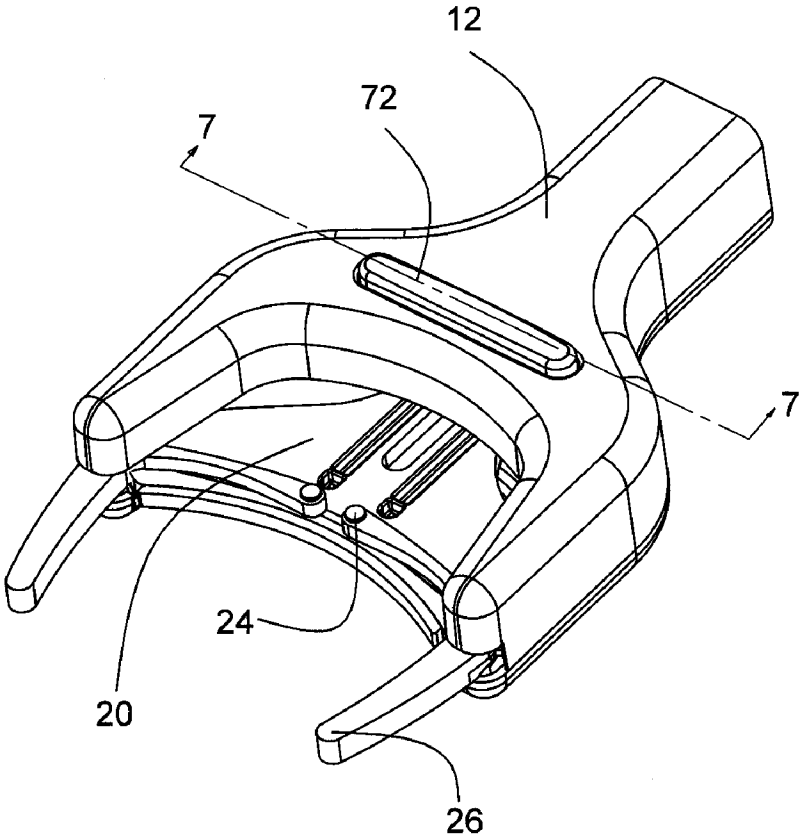
FIG. 3 is a top perspective view of one embodiment of the instant invention, illustrating the device in an open configuration.
Figure 5:
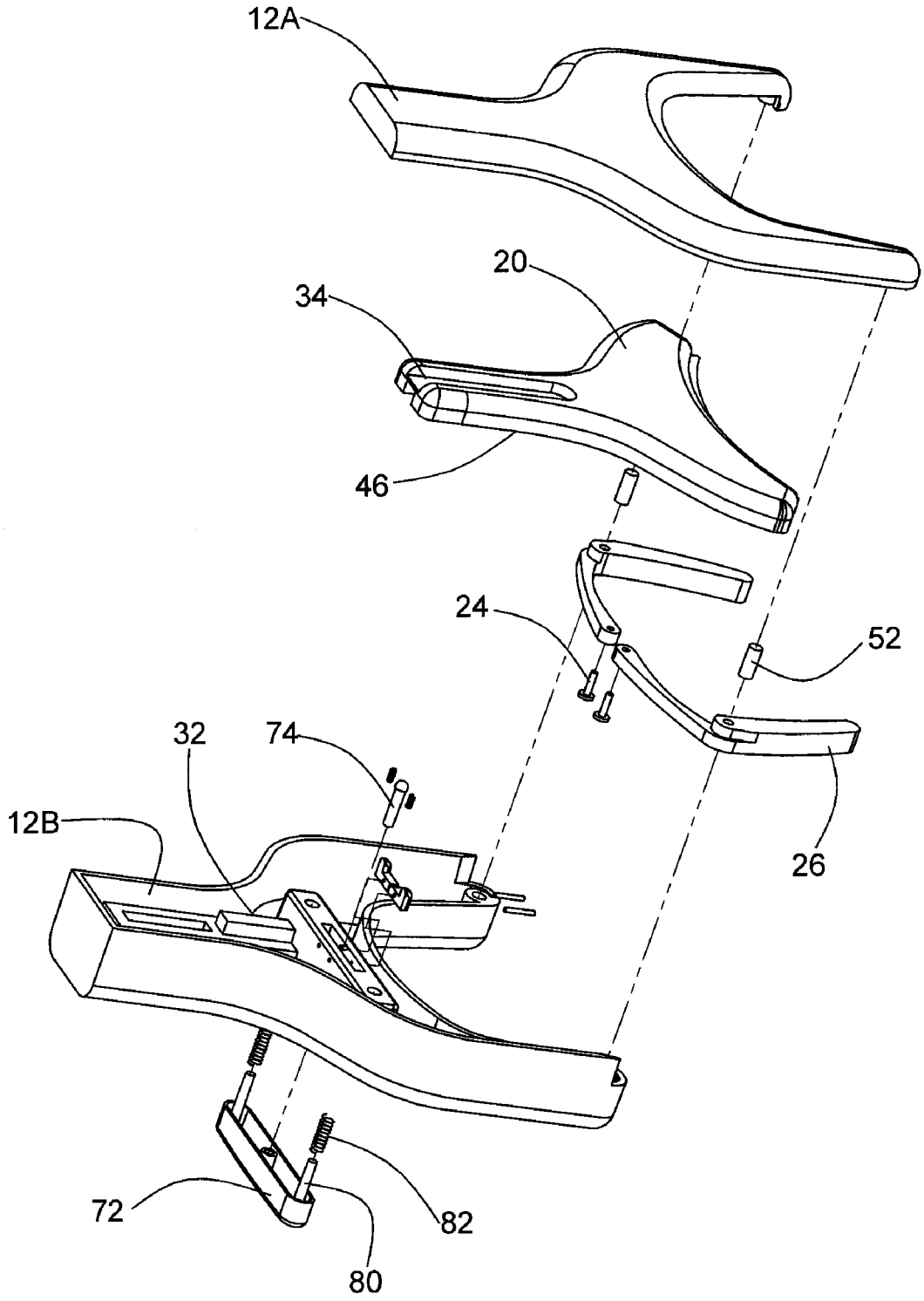
FIG. 5 is a top perspective exploded view of the embodiment illustrated in FIGS. 1-4.
Figure 6:
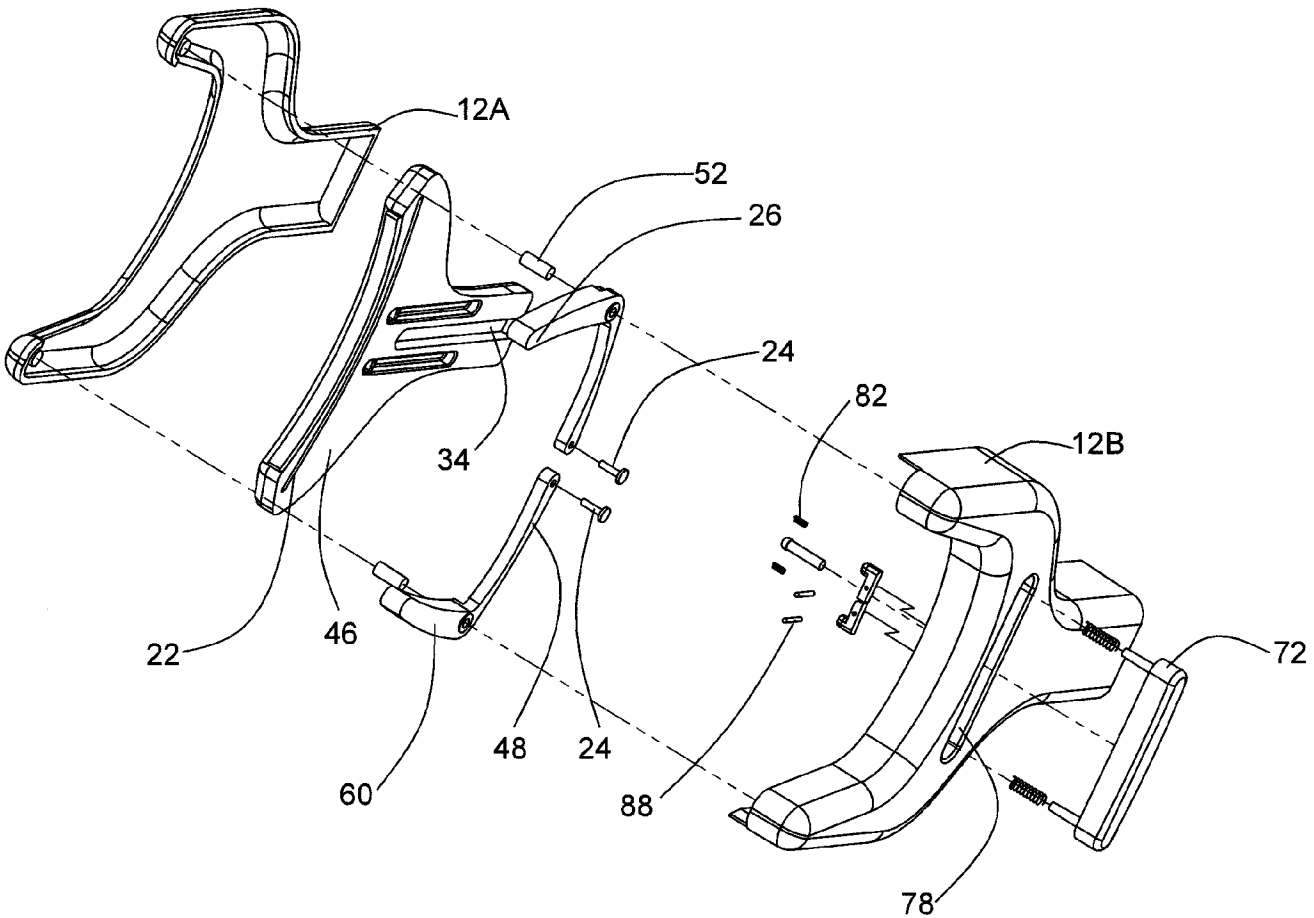
FIG. 6 is a bottom perspective exploded view of the embodiment illustrated in FIGS. 1-4.

Referring to FIGS. 1-2 and 5, a slider member 20 is positioned within the hollow portion of the body 12 to slide between a first position, and a second position. In the first position, illustrated in FIG. 1, a portion of the slider member 20 extends into the U-shaped opening 14 and in the second position, illustrated in FIG. 2, the front edge of the slider member is about even with the lower portion of the U-shaped opening. The lower surface 46 of the slider member 20 includes a keyway 34 constructed and arranged to cooperate with a key 32 formed into the lower body portion 12B (FIG.

5). The key and keyway cooperate to guide the slider in a substantially linear manner during movement.

Referring to FIGS. 1-4 and 5-6, the slider member 20 is connected to at least one, and more preferably, two L-shaped finger members 26. The finger members are generally positioned along an edge 50 of the U-shaped opening 14 for rotation about a pair of pins 52 defining a pair of axes 58. The lower surface 46 of the slider member 20 includes an integrally formed track 22 constructed and arranged to cooperate with a follower 24 secured to a first leg 48 of each finger member. In an open position, illustrated in FIGS. 1,3 and 9, the second leg 60 of each finger member 26 is position generally parallel to the edge 50 of the U-shaped opening 14 to allow for insertion of an instrument neck 16 into the U-shaped opening 14 (FIG. 9). Insertion of the instrument neck 16 supplies a force substantially perpendicular with respect to the neck and along a longitudinal axis 62 of slider member 20 to displace the slider member 20 and thereby cause rotation of the finger members 26 as the followers 24 follow the track 22.

Figure 7:
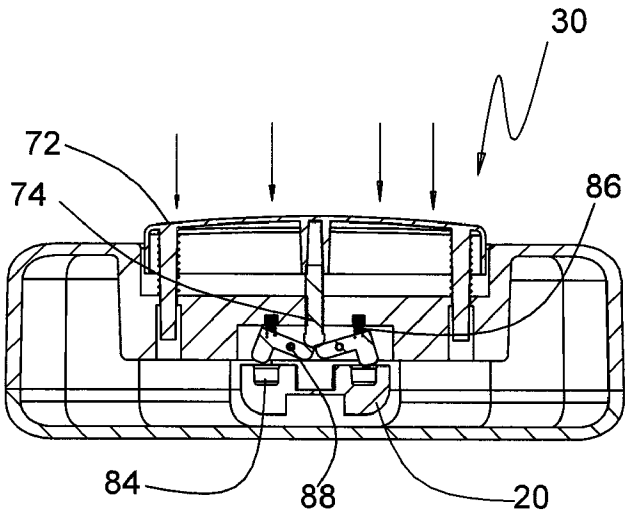
FIG. 7 is a section view taken along lines 7-7 of FIG. 1.

Referring to FIGS. 3, and 5-8, one embodiment of a locking assembly 40 is illustrated. The lock assembly 40 is generally constructed and arranged to selectively secure the slider member 20 in the second position, whereby pressing the release button 72 releases the slider and thus the fingers to return to the first position upon removal of the perpendicular force. The lock assembly generally includes a release button 72, release pin 74 and catch members 76. The release button 72 is generally sized to cooperate with a pocket 78 formed into the lower portion 12B of the body 12. A pair of guide pins 80 are provided to guide the release button between standby and operational positions and a spring 82 surrounds each of the guide pins to bias the button to the standby position. The release pin 74 is located upon a lower surface of the release button to cooperate with the catch member(s) 76. The catch members are constructed and arranged to cooperate with apertures 84 provided in the slider member 20 upon its movement to the second position. Each catch member 76 is provided with a spring 86 to bias a portion of the catch members toward the lower surface 46 of the slider member 20. The catch members 76 are preferably L-shaped and include a pivot 88 secured along a first leg thereof while the second leg is directed toward said slider member 20. In this manner, locking the slider and thus the fingers in the second (closed) position merely requires pressing the slider member 20 into the body to allow the spring biased catch members 76 to enter the apertures 84 in the slider member (FIG. 8). Releasing the slider member 20 and thus the fingers 26 merely requires depression of the release button 72. Depression of the release button compresses springs 82 so that the release pin 74 contacts the first leg of each catch member 76 causing the catch members to pivot about pivot pins 88 to retract the second leg of the catch members from the slider member 20 (FIG. 7). An alternative embodiment of the locking assembly 40 (FIG. 4) includes a key operable locking mechanism. The key operable locking mechanism includes a key 90 and a tumbler arrangement 92. The key operable locking mechanism is constructed and arranged to prevent movement of the release button until the proper key is inserted into the tumbler and rotated. It should also be noted that other types of locking mechanisms such as, but not limited to combination locks and bio-metric locks may be utilized without departing from the scope of the invention.

Figure 10:
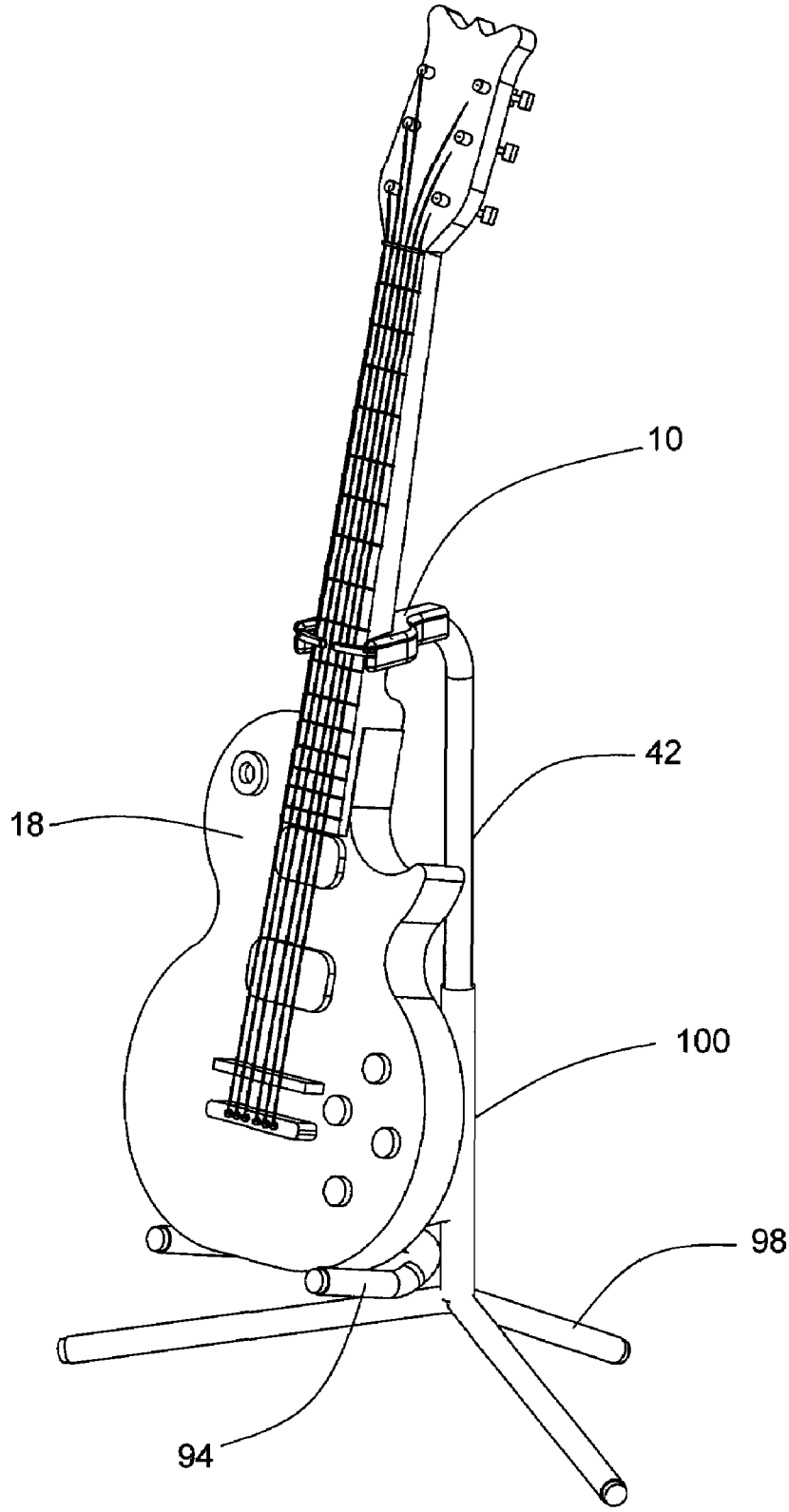
FIG. 10 is a front perspective view, illustrating the instant invention in cooperation with a freestanding instrument stand and an instrument.

Referring to FIGS. 9 and 10, various embodiments of the instant invention are illustrated in combination with free-standing instrument stands 42. In these embodiments the third leg 36 is adapted for attachment to a vertical portion of the instrument stand. The instrument stands are preferably provided with a base 98 for supporting the instrument stand on a generally flat surface and a generally vertical main section 100. The main section includes a support assembly on a lower portion thereof comprising hooks or pegs 94 for supporting the wider end of the instrument. The instrument stands 42 may be foldable for transport or they may be rigidly constructed.

Figure 11:
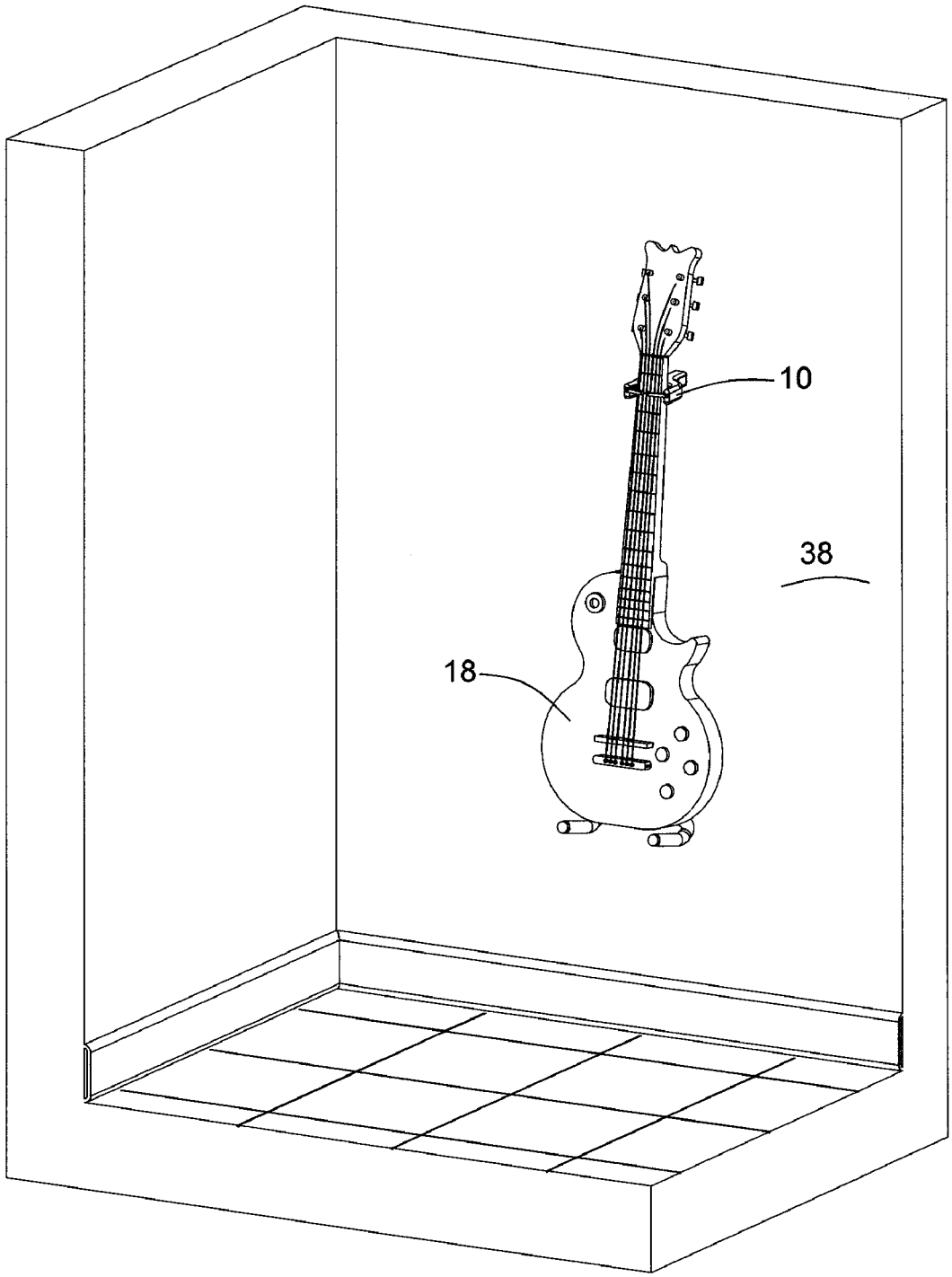
FIG. 11 is a front perspective view illustrating the instant invention in cooperation with a wall surface and an instrument.
Figure 12:
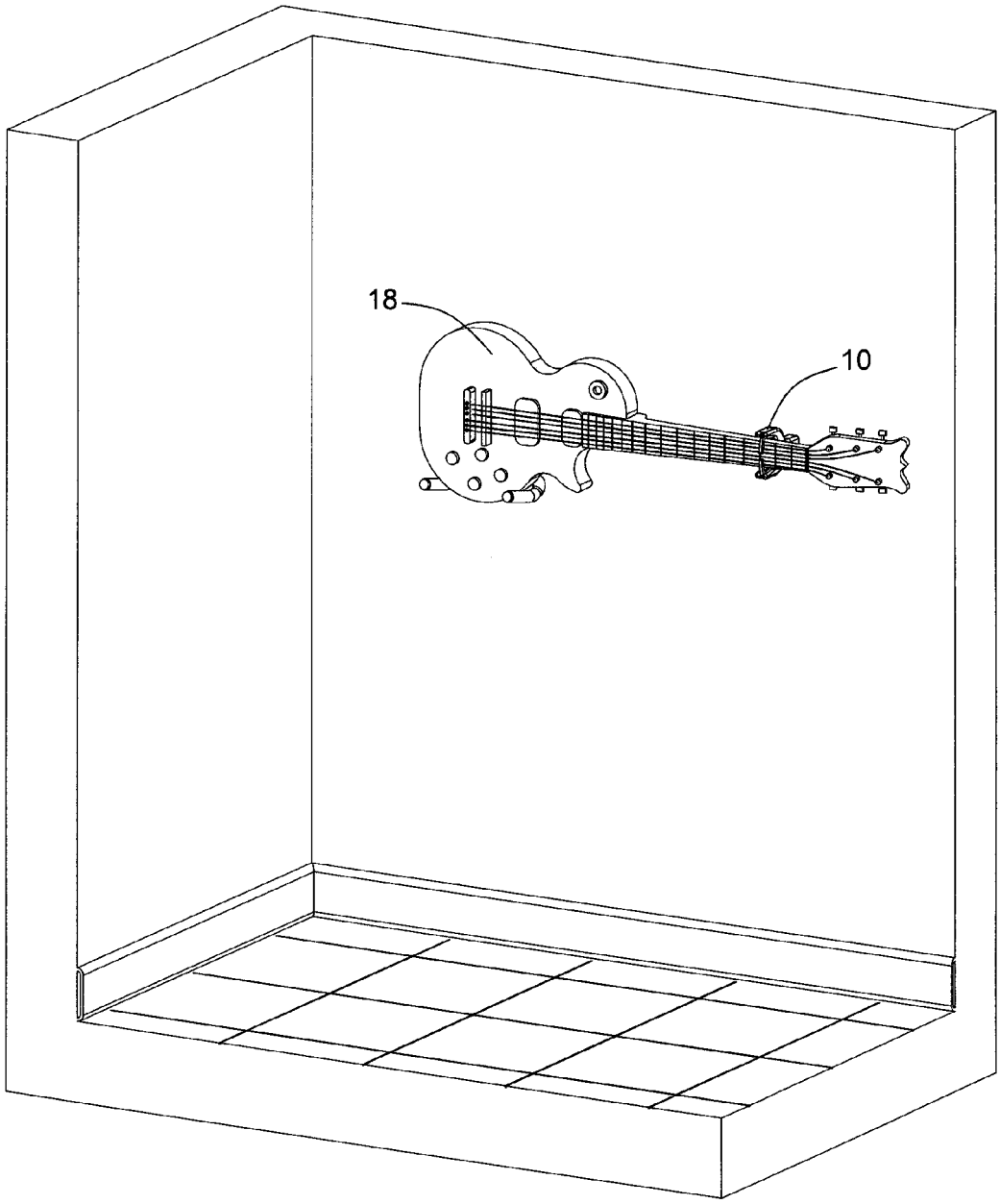
FIG. 12 is a front perspective view illustrating the instant invention in cooperation with a wall surface and an instrument in a horizontal arrangement.

Referring to FIGS. 11 and 12, front perspective views illustrating the instant invention in cooperation with a wall surface and an instrument are illustrated. In these embodiments the third leg 36 is adapted for attachment to a surface such as a wall 38. The instant invention may be secured to the surface in a vertical arrangement, illustrated in FIG. 11, or a horizontal arrangement, illustrated in FIG. 12. The surface preferably includes a support assembly on a lower portion thereof comprising hooks or pegs 94 for supporting the wider end of the instrument.

Thus a device for holding and/or displaying musical instruments that is adapted for secure removable storage of at least one musical instrument, specifically but not limited to guitars and other instruments of a similar configuration, has been illustrated. The device allows for holding and/or display of an instrument in a vertical or horizontal orientation and features the ability of being able to secure or lock as needed.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification. One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A device for securing musical instruments comprising;

a body portion having a substantially U-shaped opening, said opening sized to accept a neck portion of an instrument;

a slider member positioned within said body portion for translation between a first and a second position, a portion of said slider member adapted to extend into said U-shaped opening in said first position, said slider member connected to at least one finger member positioned along an edge of said U-shaped opening for rotation about an axis between an open and a closed position, said open position allowing insertion of said instrument neck into said U-shaped opening, said closed position substantially closing said U-shaped opening, said slider member constructed and arranged for movement between said first and said second positions upon receiving a force substantially perpendicular with respect to said neck portion of said instrument and along a longitudinal axis of slider member to cause rotation of said at least one finger member.

2. The musical instrument securing device of claim 1 wherein said finger member is L-shaped, a first leg of said finger member oriented generally parallel to said edge while said slider is in said first position, a second leg of said finger member connected to said slider member, whereby translation of said slider between said first position and said second position causes rotation of said L-shaped finger about said axis.

3. The musical instrument securing device of claim 1 including a lock assembly, said lock assembly constructed and arranged to selectively secure said slider member in said second position.

4. The musical instrument securing device of claim 3 wherein said lock assembly is releasable by moving a release button.

5. The musical instrument securing device of claim 3 wherein said lock assembly includes a lock mechanism, said lock mechanism being constructed and arranged to prevent release of said lock assembly prior to operation of said lock mechanism.

6. The musical instrument securing device of claim 3 wherein said lock assembly includes at least one catch member, said catch member constructed and arranged to cooperate with said slider member upon movement thereof to said second position.

7. The musical instrument securing device of claim 6 wherein said catch member is spring biased toward said slider member and said slider member includes at least one aperture sized and positioned to cooperate with said catch member when said slider member is in said second position.

8. The musical instrument securing device of claim 7 wherein said at least one catch member is L-shaped including a pivot pin positioned along one leg thereof the distal end of the second leg being directed toward said slider member.

9. The musical instrument securing device of claim 8 including a release button, said release button being constructed and arranged to cooperate with a distal end of said one leg of said catch member to rotate said catch member about said pivot pin out of said aperture in said slider member to release said slider member to return to said first position.

10. The musical instrument securing device of claim 1 wherein said slider member is spring biased toward said first position.

11. The musical instrument securing device of claim 1 wherein said body portion is constructed and arranged to be secured to a wall surface.

12. The musical instrument securing device of claim 1 in combination with a free-standing instrument stand, said free-standing instrument stand comprising a base for supporting said instrument stand on a generally flat surface and a generally vertical main section, said main section including a support assembly on a lower portion thereof for supporting the wider end of said instrument, said body portion constructed and arranged to be secured to an upper portion of said main section.

13. The musical instrument securing device of claim 12 wherein said free-standing instrument stand is collapsible for transport.

* * * * *